US008319769B2

(12) United States Patent
Lee et al.

(10) Patent No.: US 8,319,769 B2
(45) Date of Patent: Nov. 27, 2012

(54) LCD PANEL DRIVER WITH SELF MASKING FUNCTION USING POWER ON RESET SIGNAL AND DRIVING METHOD THEREOF

(75) Inventors: Seung-jung Lee, Seoul (KR); Do-youn Kim, Hwaseong-si (KR); Jae-hong Ko, Seoul (KR)

(73) Assignee: Samsung Electronics Co., Ltd. (KR)

( * ) Notice: Subject to any disclaimer, the term of this patent is extended or adjusted under 35 U.S.C. 154(b) by 781 days.

(21) Appl. No.: 12/387,601

(22) Filed: May 5, 2009

(65) Prior Publication Data

US 2009/0322728 A1 Dec. 31, 2009

(30) Foreign Application Priority Data

Jun. 27, 2008 (KR) ..... 10-2008-0061713

(51) Int. Cl.
*G09G 5/00* (2006.01)

(52) U.S. Cl. ..... 345/213

(58) Field of Classification Search ..... None
See application file for complete search history.

(56) References Cited

U.S. PATENT DOCUMENTS 4,822,144 A * 4/1989 Vriens ..... 349/71
6,157,247 A * 12/2000 Abdesselem et al. ..... 327/540
6,909,266 B2 * 6/2005 Kernahan et al. ..... 323/282
7,602,164 B2 * 10/2009 Vo ..... 323/282
2007/0001980 A1 1/2007 Bae
2007/0091033 A1 4/2007 Nakamura
2007/0126686 A1 6/2007 Chang et al.

FOREIGN PATENT DOCUMENTS

JP 2005084559 3/2005
JP 2007114476 5/2007
KR 1020070002955 A 1/2007
KR 1020070055817 A 5/2007

* cited by examiner

*Primary Examiner* — K. Wong
(74) *Attorney, Agent, or Firm* — Onello & Mello, LLP

(57) ABSTRACT

In a liquid crystal display (LCD) panel driver with a self-masking function using a power-on reset signal, and in a method of driving the same, the LCD panel driver includes a power-on reset signal generation unit that generates a power-on reset signal in response to a supply voltage applied to a LCD panel; a latch unit that receives a start pulse signal instructing that source lines of the LCD panel be driven and generates first and second set signals for setting an initial value of an output signal of a flip-flop to be in a predetermined default logic level, in response to the power-on reset signal; and a counter unit that generates a start pulse masking signal by masking at least one pulse of the start pulse signal in response to the first and second set signals and the start pulse signal.

10 Claims, 13 Drawing Sheets

LCD PANEL DRIVER WITH SELF MASKING FUNCTION USING POWER ON RESET SIGNAL AND DRIVING METHOD THEREOF

CROSS-REFERENCE TO RELATED APPLICATIONS

This application claims the benefit of Korean Patent Application No. 10-2008-0061713, filed on Jun. 27, 2008, in the Korean Intellectual Property Office, the disclosure of which is incorporated herein in its entirety by reference.

BACKGROUND

The inventive concept relates to a semiconductor integrated circuit, and more particularly, to a liquid crystal display (LCD) panel driver having a self-masking function that utilizes a power-on reset signal, and a method of driving the same.

An LCD panel displays image data using a matrix of pixels, each located at an intersection of a gate line and a source line. Each pixel includes a liquid crystal cell that adjusts the amount of light transmission in accordance with image data, and a thin film transistor that transmits the image data from a source line to the liquid crystal cell. An LCD panel module includes a gate driver and a source driver that respectively drive the gate lines and the source lines.

FIG. 1 illustrates the power-on sequence timing of a conventional LCD panel module. Referring to FIG. 1, a first supply voltage VDD1 and a second supply voltage VDD2 output from a source driver are applied at a point in time t1. The first supply voltage VDD1 is a voltage level suitable for driving a logic circuit of the source driver, and the second supply voltage VDD2 is a high voltage level suitable for driving the source driver. Both the first supply voltage VDD1 and the second supply voltage VDD2 are stabilized at a point in time t2. A timing controller transmits image data to the source driver several frames after a reset signal RESET output from the timing controller, which controls the LCD panel module, transitions from logic low to logic high. A horizontal start pulse signal TP output from the timing controller, which drives source lines of a LCD panel, and signals output from the source driver, which correspond to the image data, are supplied at a point of time t3.

The horizontal start pulse signal TP, which controls switches that transmit the signals output from the source driver to the source lines, is configured to turn on the switches when in a logic low state. The horizontal start pulse signal TP at a low level is supplied between the time points t1 and t3 before the signals output from the source driver are supplied, and, thus, unknown signals output from the unstable source driver are transmitted to the source lines. Thus, stripes appear on the LCD panel during an initial power-on stage, causing a display failure as illustrated in FIG. 2. The display state of the LCD panel returns to a normal state at time point t3 after several tens of milliseconds.

SUMMARY

The inventive concept provides a liquid crystal display (LCD) panel driver having a self-masking function using a power-on reset signal.

The inventive concept also provides a method of driving the LCD panel driver using the power-on reset signal.

In this manner, the liquid crystal display (LCD) panel driver and the method of driving the LCD panel driver prevent unknown image data from being displayed on the LCD panel during the initial power-on stage.

According to an aspect of the inventive concept, there is provided an LCD panel driver including a power-on reset signal generation unit that generates a power-on reset signal in response to a supply voltage applied to a LCD panel; a latch unit that receives a start pulse signal instructing that source lines of the LCD panel be driven, and that generates first and second set signals for setting an initial value of an output signal of a flip-flop to be a predetermined default logic level, in response to the power-on reset signal; and a counter unit comprising the flip-flop that operates in response to the first and second set signals and the start pulse signal, and that generates a start pulse masking signal by masking at least one pulse of the start pulse signal.

The supply voltage may be a high supply voltage for driving a source driver.

The LCD panel driver may further include a level shifter that generates first and second switching signals by boosting a voltage of the start pulse masking signal to a high voltage; and an output buffer that transmits image data as an output signal for driving the source lines of the LCD panel, in response to the first and second switching signals.

The power-on reset signal generation unit may include a bias unit that generates first and second node voltages when the supply voltage is powered up; a current mirror unit comprising first and second current mirrors which generate third node voltages in response to the second node voltage; and a buffer unit that generates the power-on reset signal by buffering the first node voltage.

The bias unit may include first through third PMOS transistors. The first PMOS transistor has a source to which the supply voltage is applied and a gate and drain to which first node voltage is applied. The second NMOS transistor has a drain to which the first node voltage is applied, a gate to which the third node voltage is applied, and a source to which a ground voltage is applied. The third NMOS transistor has a gate to which the first node voltage is applied, a drain to which the second node voltage is applied, and a source to which the ground voltage is applied.

The current mirror unit may include fourth and fifth PMOS transistors and sixth and seventh NMOS transistors. The fourth PMOS transistor has a source to which the supply voltage is applied, and a gate and drain to which the second node voltage is applied. The sixth PMOS transistor has a source to which the supply voltage is applied, a gate to which the second node voltage is applied, and a drain to which the third node voltage is applied. The sixth PMOS transistor forms the first current mirror together with the fourth PMOS transistor. The fifth NMOS transistor has a source to which the ground voltage is applied, a drain connected to the drain of the fourth PMOS transistor, and a gate to which the third node voltage is applied. The seventh NMOS transistor has a source to which the ground voltage is applied and a gate and drain to which the third node voltage is applied. The seventh NMOS transistor forms the second current mirror together with the fifth NMOS transistor.

The latch unit may include first through sixth inverters and first and second NAND gate. The first through third inverters are connected in series to receive the power-on reset signal. The fourth inverter receives the start pulse signal fourth inverter. The first NAND gate receives an output of the third inverter and an output of a second NAND gate and outputs a set signal. The second NAND gate receives an output of the first inverter, an output of the fourth inverter and an output of the first NAND gate. The fifth inverter receives the set signal and outputs the first set signal. The sixth inverter receives the first set signal and outputs the second set signal.

The counter unit may include first through fifth flip-flops, a delay unit and an OR gate. The first flip-flop is enabled in response to the first and second set signals, receives the start pulse signal via a clock input terminal thereof and respectively outputs the divided-by-2 pulse signal and an inverted divided-by-2 pulse signal via an output terminal and an inversion output terminal thereof. The second flip-flop is enabled in response to the first and second set signals, receives the divided-by-2 pulse signal via a clock input terminal thereof, and outputs the divided-by-4 pulse signal via an output terminal thereof. The third flip-flop is enabled in response to the first and second set signals, receives the divided-by-4 pulse signal via a clock input terminal thereof, and outputs the divided-by-8 pulse signal via an output terminal thereof. The fourth flip-flop is enabled in response to the first and second set signals, receives the divided-by-8 pulse signal via a clock input terminal thereof and outputs the divided-by-16 pulse signal via an output terminal thereof. The delay unit outputs a delayed divided-by-16 pulse signal by delaying the divided-by-16 pulse signal for a predetermined time. The fifth flip-flop receives the delayed divided-by-16 pulse signal via a clock input terminal thereof, receives the divided-by-2 pulse signal via a data input terminal thereof, receives the divided-by-2 pulse signal via an inversion data input terminal thereof, and outputs an enable signal via an inversion output terminal thereof. The OR gate receives the start pulse signal and the enable signal and generates the start pulse masking signal.

Each of the first through fourth flip-flops may include first through fourth switches, a default high lath and a default low latch. The first switch transmits a signal of an inversion output terminal thereof in response to a signal received from an inversion clock input terminal. The second switch transmits a signal of an output terminal thereof in response to the signal received from the inversion clock input terminal. The default high latch has an output terminal set to be in a default logic low level and respectively receives the signal of the inversion output terminal of the first switch and the signal of the output terminal of the second switch via an input terminal and an inversion input terminal thereof, in response to the first and second set signals. The third and fourth switches respectively transmit signals of the inversion output terminal and output terminal of the default high latch, in response to a signal received from a clock input terminal. The default low latch has an output terminal that is set to be in a default logic low level in response to the first and second set signals, respectively receives the signal of the inversion output terminal of the third switch and the signal of the output terminal of the fourth switch via an input terminal and an inversion input terminal thereof, and has an inversion output terminal and the output terminal are respectively connected to the output terminal and the inversion output terminal of each of the first through fourth flip-flops.

The default high latch includes first through fourth NMOS transistors, a fourth switching NMOS transistor, first through fourth, sixth and seventh PMOS transistors, and a first switching PMOS transistor. The first NMOS transistor has a source to which the ground voltage is applied, a gate to which the signal of the input terminal is supplied, and a drain to which the signal of the inversion output terminal is supplied. The second NMOS transistor has a source to which the ground voltage is applied, a gate to which the signal of the inversion input terminal is supplied, and a drain to which the signal of the output terminal is supplied. The third NMOS transistor has a source to which the ground voltage is applied, a gate to which the first set signal is supplied, and a drain to which the signal of the inversion output terminal is supplied. The fourth NMOS transistor has a source to which the ground voltage is applied, and a gate to which the clock terminal signal is supplied. The fourth switching NMOS transistor has a source connected to a drain of the fourth NMOS transistor, a gate to which the signal of the output terminal is supplied, and a drain to which the signal of the inversion input terminal is supplied. The first and second PMOS transistors are connected in series between a first supply voltage source and the drain of the second NMOS transistor and have drains connected to the drain of the first NMOS transistor. The third and fourth PMOS transistors are connected in series between the first supply voltage source and the drain of the first NMOS transistor and have drains connected to the drain of the second NMOS transistor. The sixth PMOS transistor has a source connected to the first supply voltage source and a gate to which the signal of the inversion clock terminal is supplied. The first switching PMOS transistor has a source connected to the drain of the sixth PMOS transistor, a gate to which the signal of the inversion output terminal is supplied, and a drain to which the signal of the input terminal is supplied. The seventh PMOS transistor is connected between the first supply voltage source and the output terminal and has a gate to which the second set signal is supplied.

The default low latch may include first through fourth NMOS transistors, a fourth switching NMOS transistor, first through fourth, sixth and seventh PMOS transistors, and a first switching PMOS transistor. The first NMOS transistor has a source to which the ground-voltage is applied, a gate to which the signal of the inversion input terminal is supplied, and a drain to which the signal of the output terminal is supplied. The second NMOS transistor has a source to which the ground voltage is applied, a gate to which the signal of the input terminal is supplied, and a drain to which the signal of the inversion output terminal is supplied. The third NMOS transistor has a source to which the ground voltage is applied, a gate to which the first set signal is supplied, and a drain to which the signal of the output terminal is supplied. The fourth NMOS transistor has a source to which the ground voltage is applied, and a gate to which the signal of the inversion clock terminal is supplied. The fourth switching NMOS transistor has a source connected to the drain of the fourth NMOS transistor, a gate to which the signal of the inversion output terminal is supplied, and a drain to which the signal of the input terminal is supplied. The first and second PMOS transistors are connected in series between the first supply voltage source and the drain of the first NMOS transistor and have gates connected to the drain of the second NMOS transistor. The third and fourth PMOS transistors are connected in series between the first supply voltage source and the drain of the second NMOS transistor and have gates connected to the drain of the first NMOS transistor. The sixth PMOS transistor has a source connected to the first supply voltage source and a gate to which the clock terminal signal is supplied. The first switching PMOS transistor has a source connected to the drain of the sixth PMOS transistor, a gate to which the signal of the output terminal is supplied, and a drain to which the signal of the inversion input terminal is supplied. The seventh PMOS transistor is connected between the first supply voltage source and the inversion output terminal and has a gate to which the second set signal is supplied.

The fifth flip-flop may include first through fourth switches, a default low latch and a default high latch. The first switch delivers a signal of a data input terminal thereof in response to the signal received from the clock input terminal. The second switch delivers a signal of an inversion data input terminal thereof in response to the signal received from the clock input terminal. The default low latch has an output terminal that is set to be in a default logic low level and respectively receives the signal of the data input terminal of the first switch and the signal of the inversion data input terminal of the second switch via an input terminal and an inversion input terminal thereof. The third switch delivers a signal of the inversion output terminal of the default low latch in response to the signal of the inversion clock input terminal. The fourth switch delivers a signal of the output terminal of the default low latch in response to the signal of the inversion clock input terminal. The default high latch includes an output terminal that is set to be in a default logic high level, respectively receives the signal of the inversion output terminal, which is transmitted via the third switch, and the signal of the output terminal, which is transmitted via the fourth switch, via an input terminal and an inversion input terminal thereof, and has an inversion output terminal and the output terminal that are respectively connected to the output terminal of the fourth flip-flop and the inversion output terminal.

The default low latch may include first through fourth NMOS transistors, third and fourth switching NMOS transistors, first through third PMOS transistors, and first and second switching PMOS transistors. The first NMOS transistor has a source to which the ground voltage is applied, a gate connected to the inversion input terminal, and a drain connected to the output terminal. The second NMOS transistor has a source to which the ground voltage is applied, a gate connected to the input terminal, and a drain connected to the inversion output terminal. The third NMOS transistor has a source to which the ground voltage is applied, and a gate connected to the inversion clock terminal. The third switching NMOS transistor has a source connected to the drain of the third NMOS transistor, a gate to which the signal of the output terminal is supplied, and a drain to which the signal of the inversion input terminal is supplied. The fourth NMOS transistor has a source to which the ground voltage is applied, and a gate to which the inverted clock terminal signal is supplied. The fourth switching NMOS transistor has a source of the drain of the fourth NMOS transistor, a gate to which the signal of the inversion output terminal is supplied, and a drain to which the input terminal is supplied. The first PMOS transistor has a source to which the supply voltage is applied, a gate connected to the inversion output terminal and a drain connected to the drain of the first NMOS transistor. The second PMOS transistor has a source to which the supply voltage is applied, a gate connected to the output terminal, and a drain connected to the drain of the second NMOS transistor. The third PMOS transistor has a source to which the supply voltage is applied and a gate to which the clock terminal signal is supplied. The first switching PMOS transistor has a source connected to the drain of the third PMOS transistor, a gate to which the output terminal signal is supplied, and a drain to which the signal of the inversion input terminal is supplied. The fourth PMOS transistor has a source to which the supply voltage is applied and a gate to which the clock terminal signal is supplied. The second switching PMOS transistor has a source connected to the drain of the fourth PMOS transistor, a gate to which the signal of the inversion output terminal is supplied, and a drain connected to the input terminal. The width of the first NMOS transistor may be greater than that of the second NMOS transistor.

The default high latch may include first through fourth NMOS transistors, third and fourth switching NMOS transistors, first through fourth PMOS transistors, first and second switching PMOS transistors. The first NMOS transistor has a source to which the ground voltage is applied, a gate connected to the input terminal, and a drain connected to the inversion output terminal. The second NMOS transistor has a source to which the ground voltage is applied, a gate connected to the inversion input terminal, and a drain connected to the output terminal. The third NMOS transistor has a source to which the ground voltage is applied, and a gate connected to the clock terminal. The third switching NMOS transistor has a source connected to the drain of the third NMOS transistor, a gate to which the signal of the inversion output terminal is supplied, and a drain to which the signal of the input terminal is supplied. The fourth NMOS transistor has a source to which the ground voltage is applied and a gate to which the clock terminal signal is supplied. The fourth switching NMOS transistor has a source connected to the drain of the fourth NMOS transistor, a gate to which the signal of the output terminal is supplied, and a drain to which the signal of the inversion input terminal is supplied. The first PMOS transistor has a source to which the supply voltage is applied, a gate connected to the inversion output terminal, and a drain connected to the drain of the second NMOS transistor. The second PMOS transistor has a source to which the supply voltage is applied, a gate connected to the output terminal, and a drain connected to the drain of the first NMOS transistor. The third PMOS transistor has a source to which the supply voltage is applied and a gate to which the inverted clock terminal signal is supplied. The first switching PMOS transistor has a source connected to the drain of the third PMOS transistor, a gate to which the signal of the inversion output terminal is supplied, and a drain to which the signal of the input terminal is supplied. The fourth PMOS transistor has a source to which the supply voltage is applied and a gate to which the inverted clock terminal signal is supplied. The second switching PMOS transistor has a source connected to the drain of the fourth PMOS transistor, a gate to which the signal of the output terminal is supplied, and a drain connected to the inversion input terminal. The width of the first NMOS transistor may be greater than that of the second NMOS transistor.

The first supply voltage may be a supply voltage for driving a logic circuit of the source driver.

According to another aspect of the inventive concept, there is provided a liquid crystal display (LCD) panel driving method including generating a power-on reset signal in response to a supply voltage applied to a LCD panel; receiving a start pulse signal instructing that source lines of the LCD panel be driven from a timing controller; generating a set signal for setting an initial value of an output signal of a flip-flop to be a predetermined default logic level, in response to the power-on reset signal; generating a start pulse masking signal by masking at least one pulse of the start pulse signal using a flip-flop that operates in response to the set signal and the start pulse signal; and driving the source lines in response to the start pulse masking signal.

The start pulse masking signal may control switches between the source lines of the LCD panel and a source driver.

The first supply voltage can be a supply voltage for driving a logic circuit of the source driver.

The generating of the start pulse masking signal may include generating a divided-by-2 pulse signal, where the divided-by-2 pulse signal is driven by applying a first supply voltage and is set to be in an logic high level in response to the set signal, and the logic level of the divided-by-2 pulse signal is inverted at each of rising edges of the start pulse signal; generating a divided-by-4 pulse signal, where the divided-by-4 pulse signal is driven by applying the first supply voltage and is set to be in an initial logic high level in response to the set signal, and the logic level of the divided-by-4 pulse signal is inverted at each of rising edges of the divided-by-2 pulse signal; generating a divided-by-8 pulse signal, where the divided-by-8 pulse signal is driven by applying the first supply voltage and is set to be in an initial logic high level in response to the set signal, the logic level of the generating a divided-by-8 pulse signal is inverted at each of rising edges of the divided-by-4 pulse signal; generating a divided-by-16 pulse signal, where the divided-by-16 pulse signal is driven by applying the first supply voltage and is set to be in an initial logic high level in response to the set signal, and the logic level of the generating a divided-by-16 pulse signal is inverted at each of rising edges of the divided-by-8 pulse signal; generating a delayed divided-by-16 pulse signal by delaying the divided-by-16 pulse signal for a predetermined time; generating an enable signal at a falling edge of the delayed divided-by-16 pulse signal and in response to the divided-by-2 pulse signal and the inverted divided-by-2 pulse signal; and generating the start pulse masking signal by performing an OR operation on the enable signal and the start pulse signal.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF EMBODIMENTS

Figure 1:
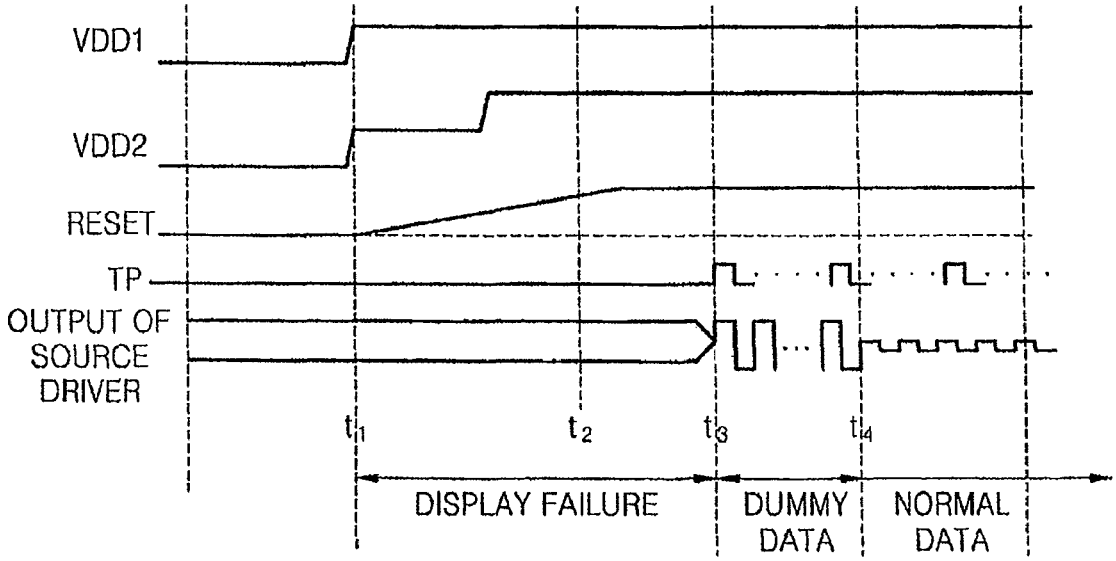
FIG. 1 (PRIOR ART)
FIG. 1 illustrates a power-on sequence timing of a conventional liquid crystal display (LCD) panel module.

Exemplary embodiments will now be described more fully with reference to the accompanying drawings. Like reference numerals denote like elements throughout the drawings.

Figure 2:
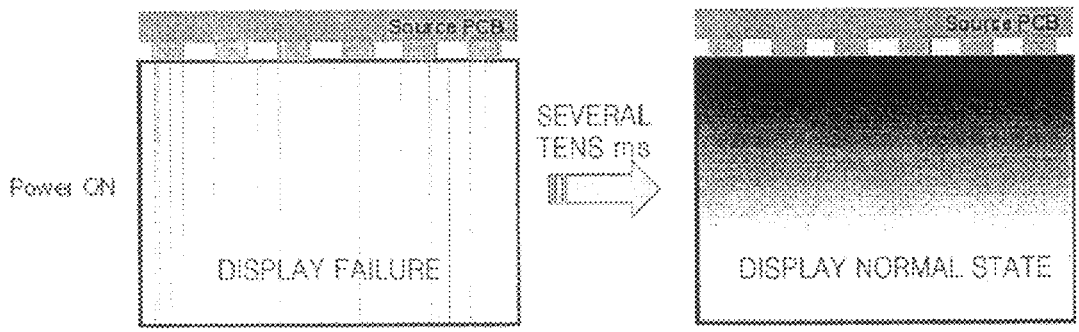
FIG. 2 (PRIOR ART)
FIG. 2 illustrates a display failure occurring in a LCD panel described with reference to FIG. 1 during an initial power-on stage.
Figure 3:
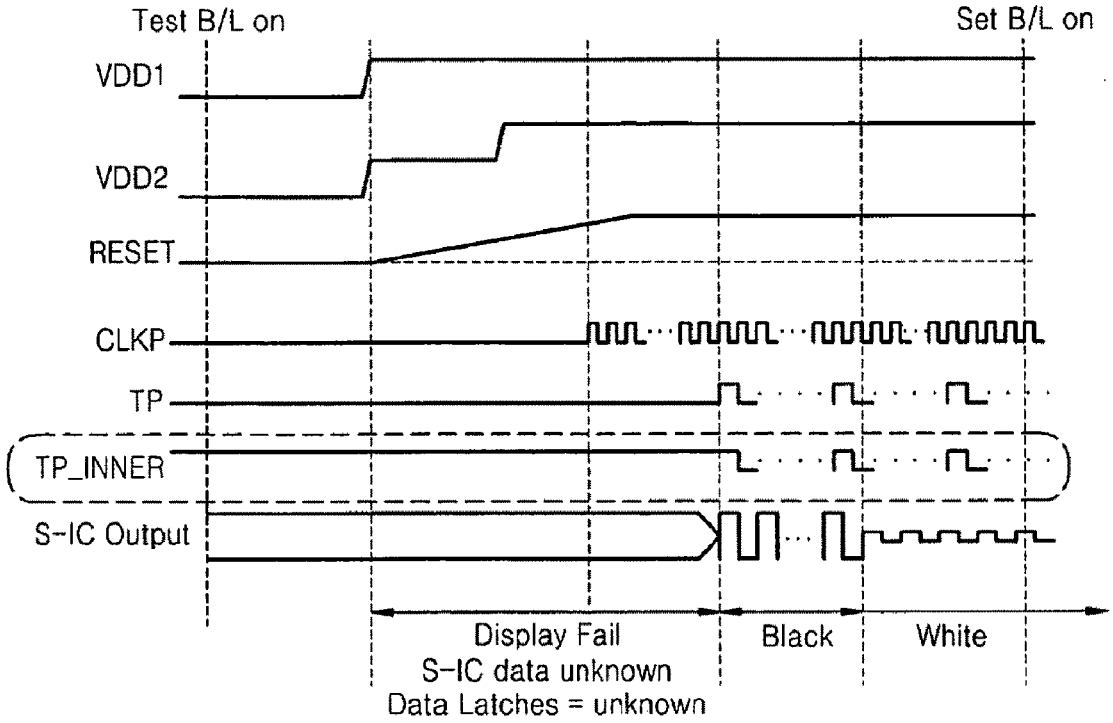
FIG. 3 illustrates a power-on sequence timing of an embodiment of a LCD panel module according to an embodiment.

In order to prevent a display failure as illustrated in FIG. 2, it is possible to prevent unknown output signals from being transmitted to source lines during an initial power-on stage by turning off switches for delivering signals output from a source driver to the source lines, using a start pulse masking signal TP_INNER that is in a high state and is obtained by masking a horizontal start pulse signal TP at a logic high level during the initial power-on stage. The inventive concept provides a liquid crystal display (LCD) panel driver that generates the start pulse masking signal TP_INNER having a self-masking function using a power-on reset signal, and a power-on sequence timing of a LCD panel module as illustrated in FIG. 3.

Figure 4:
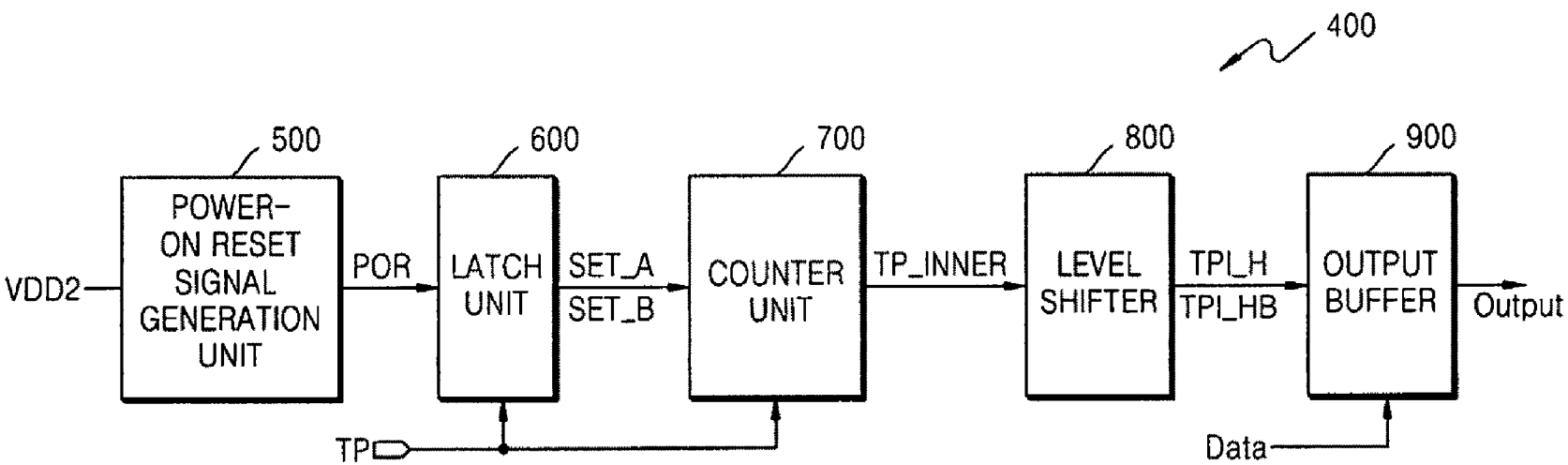
FIG. 4 is a block diagram of a LCD panel driver according to an embodiment.

FIG. 4 is a block diagram of a LCD panel driver 400 according to an embodiment. Referring to FIG. 4, the LCD panel driver 400 includes a power-on reset signal generation unit 500, a latch unit 600, a counter unit 700, a level shifter 800, and an output buffer 900. The power-on reset signal generation unit 500 generates a power-on reset signal POR when a second supply voltage VDD2 is powered up. The latch unit 600 generates first set signal SET_A and a second set signal SET_B, in response to the power-on reset signal POR and a start pulse signal TP. The counter unit 700 generates a start pulse masking signal TP_INNER, in response to the first and second set signals SET_A and SET_B and the start pulse signal TP. The level shifter 800 generates a first switching signal TPI_H and a second switching signal TPI_HB by boosting the voltage of the start pulse masking signal TP_INNER to a high voltage. The output buffer 900 transmits image data Data as an output signal Output for driving source lines of a LCD panel, in response to the first and second switching signals TPI_H and TPI_HB.

Figure 5A:
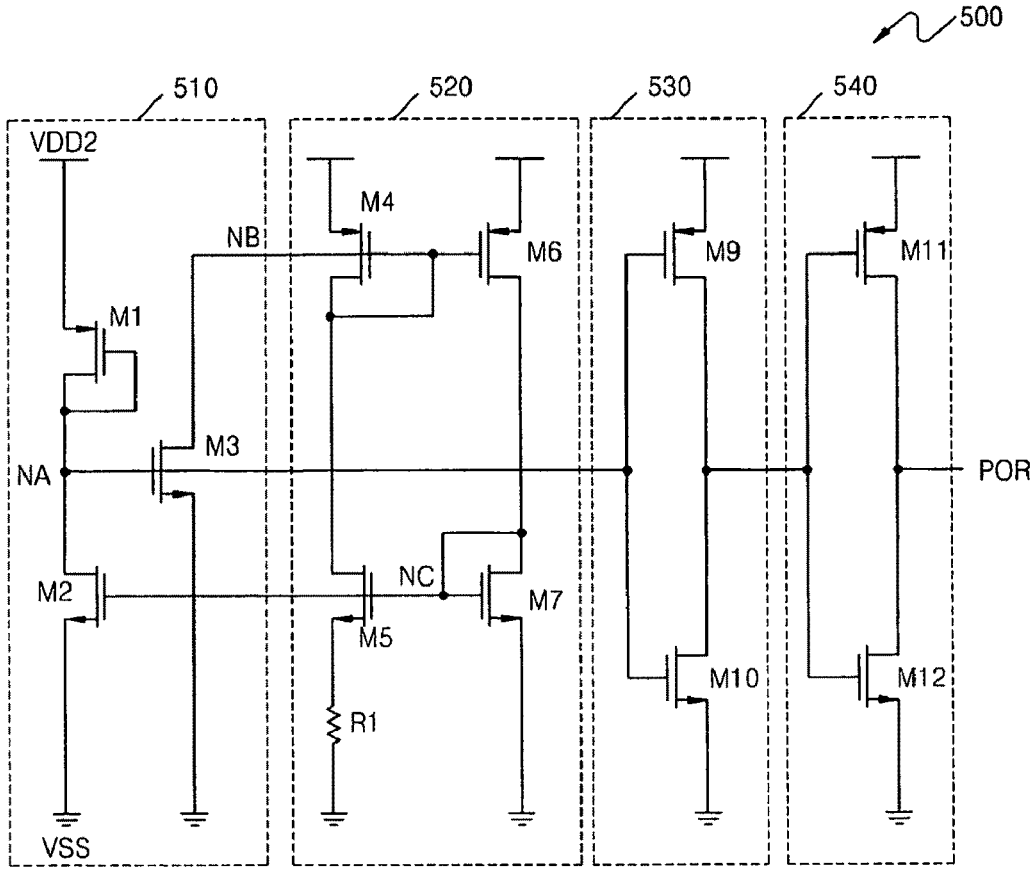
FIG. 5A is a circuit diagram of a power-on reset circuit of FIG. 4 according to an embodiment.

FIG. 5A is a circuit diagram of the power-on reset circuit 500 of FIG. 4 according to an embodiment. Referring to FIG. 5A, the power-on reset circuit 500 includes a bias unit 510, a current mirror unit 520 and first and second buffer units 530 and 540. The bias unit 510 includes a first PMOS transistor M1 and a second NMOS transistor M2 that are connected in series between a second supply voltage source VDD2 and a ground voltage source VSS. A first node NA is located at a point where the first PMOS transistor M1 and the second NMOS transistor M2 are connected to each other. The first PMOS transistor M1 is configured as a diode-type transistor, in which a source is connected to the second supply voltage source VDD2 and a gate and a drain are connected to the first node NA. In the second NMOS transistor M2, a drain is connected to the first node NA, a gate is connected to a third node NC, and a source is connected to the ground voltage source VSS. A second node NB is provided in the current mirror unit 520.

The bias unit 510 further includes a third NMOS transistor M3 connected to the first node NA. In the third NMOS transistor M3, a gate is connected to the first node NA, a drain is connected to the second node NB, and a source is connected to the ground voltage source VSS.

The current mirror unit 520 includes a fourth PMOS transistor M4, a fifth NMOS transistor M5, a sixth PMOS transistor M6, and a seventh NMOS transistor M7. In the fourth PMOS transistor M4, a source is connected to the second supply voltage source VDD2 and a gate and a drain are connected to the second node NB. In the sixth PMOS transistor M6, a source is connected to the second supply voltage source VDD2, a gate is connected to the second node NB, and a drain is connected to the third node NC. The fourth and sixth PMOS transistors M4 and M6 together form a first current mirror and are arranged so that their transistor characteristics may appropriately match one another.

In the fifth NMOS transistor M5, a source is connected to the ground voltage source VSS through an optional resistor R1, a drain is connected to the drain of the fourth PMOS transistor M4, and a gate is connected to the third node NC. In the seventh NMOS transistor M7, a source is connected to the ground voltage source VSS and a gate and a drain are connected to the third node NC. The fifth NMOS transistor M5 and the seventh NMOS transistor M7 together form a second current mirror and are arranged so that their transistor characteristics may appropriately match one another.

The first buffer unit 530 includes a ninth PMOS transistor M9 and a tenth NMOS transistor M10 that are connected in series between the second supply voltage source VDD2 and the ground voltage source VSS. The gates of the ninth PMOS transistor M9 and the tenth NMOS transistor M10 which are input terminals of the first buffer unit 530 are connected to the first node NA. The second buffer unit 440 includes an eleventh PMOS transistor M11 and a twelfth NMOS transistor M12 that are connected in series between the second supply voltage source VDD2 and the ground voltage source VSS. An output of the first buffer unit 530 is supplied to the gates of the eleventh PMOS transistor M11 and the twelfth NMOS transistor M12. The second buffer unit 540 receives the output of the first buffer unit 530 and then outputs a power-on reset signal POR.

Figure 5B:
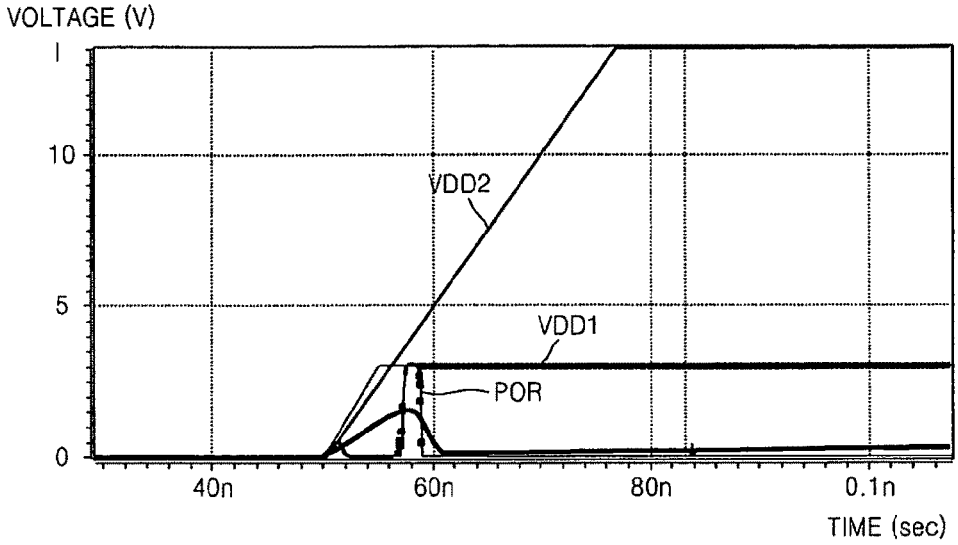
FIG. 5B is a graph illustrating operation of the power-on reset circuit of FIG. 4 according to an embodiment.

FIG. 5B is a graph illustrating the operation of the power-on reset circuit 500 of FIG. 4 according to an embodiment. Referring to FIGS. 5A and 5B, an increase in the second supply voltage VDD2 causes the first PMOS transistor M1 to turn on, thus increasing the voltage of the first node NA. An increase in the voltage of the first node NA causes the third NMOS transistor M3 to turn on, thus pulling down the voltage of the second node NB. Thus, when current flows through the fourth PMOS transistor M4, the sixth PMOS transistor M6 is mirrored, thus increasing the voltage of the third node NC. When the voltage of the third node NC increases, the second NMOS transistor M2 is turned on to lower the voltage of the first node NA, and thus the third NMOS transistor M3 is turned off. The voltage of the first node NA is triggered by the first buffer unit 430 and then is generated as a power-on reset signal POR.

Figure 6:
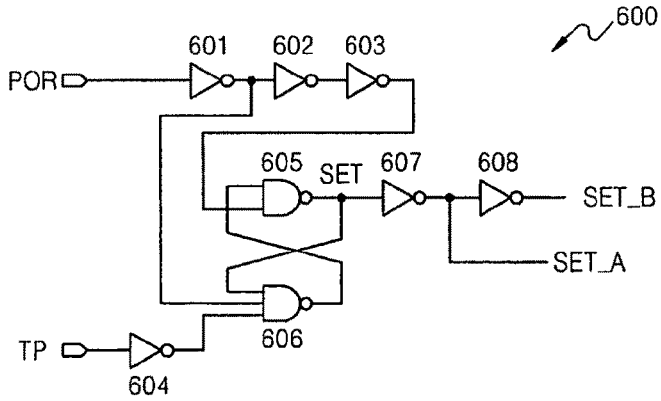
FIG. 6 is a circuit diagram of a latch unit of FIG. 4 according to an embodiment.

FIG. 6 is a circuit diagram of the latch unit 600 according to an embodiment. Referring to FIG. 6, the latch unit 600 includes first through third inverters 601, 602, and 603 that are connected in series and to which a power-on reset signal POR is supplied, and a fourth inverter 604 to which a start pulse signal TP is supplied. The latch unit 600 includes a first NAND gate 605 that receives an output of the third inverter 603 and an output of the second NAND gate 606 and then outputs a set signal SET, and a second NAND gate 606 that receives an output of the first inverter 601, an output of the fourth inverter 604 and an output of the first NAND gate 605. The fifth inverter 607 receives the set signal SET and outputs a first set signal SET_A, and the sixth inverter 608 receives the first set signal SET_A and outputs a second set signal SET_B.

Figure 7:
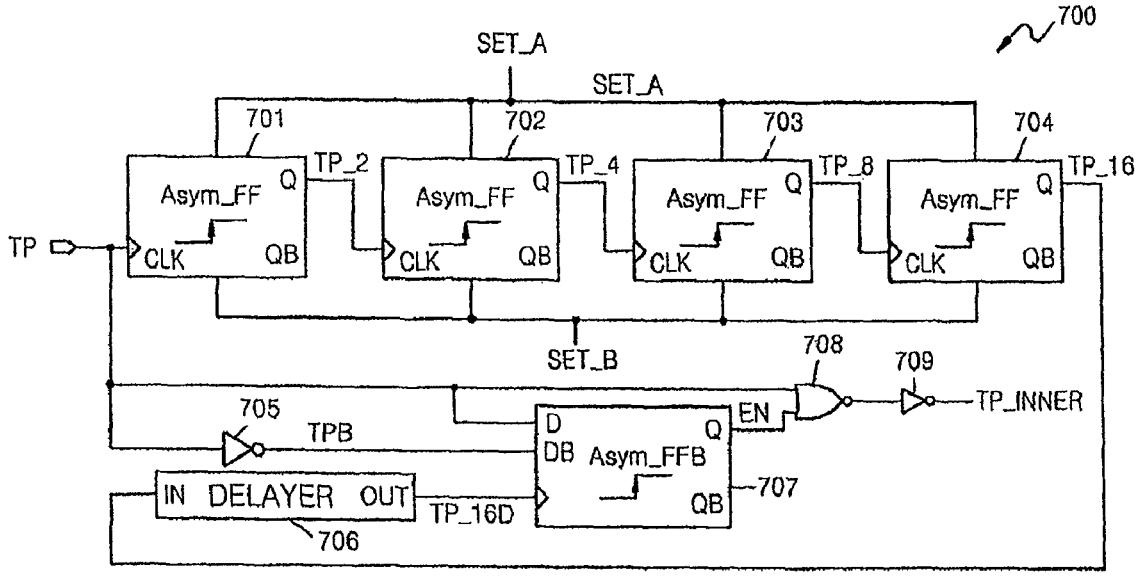
FIG. 7 is a circuit diagram of a counter unit of FIG. 4 according to an embodiment.

FIG. 7 is a circuit diagram of the counter unit 700 of FIG. 4 according to an embodiment. Referring to FIG. 7, the counter unit 700 includes first through fifth flip-flops 701, 702, 703, 704, and 707, a first inverter 705, a delay unit 706, a NOR gate 708 and a second inverter 709. The first through fifth flip-flops 701, 702, 703, 704, 707 are clock-dividing flip-flops that use asymmetrical latches. Initial values of output signals of the first through fifth flip-flops 701, 702, 703, 704, and 707 are set by the asymmetrical latches. The first through fourth flip-flops 701 through 704 are enabled in response to first and second set signals SET_A and SET_B, and respectively divide a start pulse signal TP into a divided-by-2 pulse signal TP_2, a divided-by-4 pulse signal TP_4, a divided-by-8 pulse signal TP_8, and a divided-by-16 pulse signal TP_16.

The first flip-flop 701 receives the start pulse signal TP via a clock input terminal CLK thereof, and respectively outputs the divided-by-2 pulse signal TP_2 and an inverted divided-by-2 pulse signal TP_2_B via an output terminal Q and an inversion output terminal QB thereof. The second flip-flop 702 receives the divided-by-2 pulse signal TP_2 via a clock input terminal CLK thereof, and outputs the divided-by-4 pulse signal TP_4 via an output terminal Q thereof. The third flip-flop 703 receives the divided-by-4 pulse signal TP_4 via a clock input terminal CLK, and outputs the divided-by-8 pulse signal TP_8 via an output terminal Q thereof. The fourth flip-flop 704 receives the divided-by-8 pulse signal TP_8 via a clock input terminal CLK, and outputs the divided-by-16 pulse signal TP_16 via an output terminal Q thereof.

The first inverter 705 receives the start pulse signal TP and outputs an inverted start pulse signal TPB. The delay unit 706 receives the divided-by-16 pulse signal TP_16 and outputs a delayed divided-by-16 pulse signal TP_16D. The fifth flip-flop 707 receives the delayed divided-by-16 pulse signal TP_16D via a clock input terminal CLK thereof, receives the start pulse signal TP via a data input terminal D thereof, receives the inverted start pulse signal TPB inversion data input terminal DB thereof, and then outputs an enable signal EN via an output terminal Q thereof. The NOR gate 708 receives the start pulse signal TP and the enable signal EN. The second inverter 709 receives an output of the NOR gate 708 and then outputs a start pulse masking signal TP_INNER.

Figure 8:
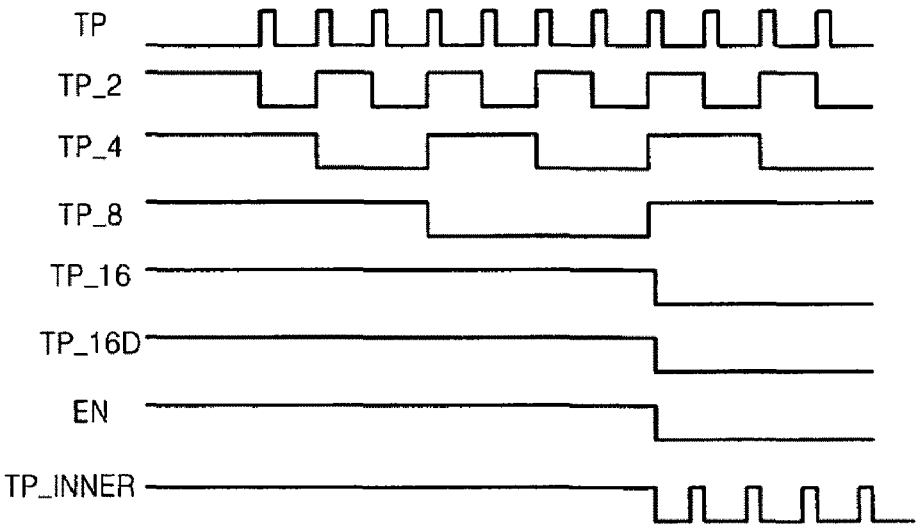
FIG. 8 is a timing diagram illustrating operation of the counter unit of FIG. 7 according to an embodiment.

FIG. 8 is a timing diagram illustrating an operation of the counter unit 700 of FIG. 7 according to an embodiment. Referring to FIG. 8, if a start pulse signal TP is input to a timing controller (not shown), a divided-by-2 pulse signal TP_2 transitions from an initial logic high level to a logic low level at a rising edge of the start pulse signal TP. Then the logic level of the divided-by-2 pulse signal TP_2 is inverted at each rising edge of the start pulse signal TP. A divided-by-4 pulse signal TP_4 transitions from an initial logic high level to a logic low level at a rising edge of the divided-by-2 pulse signal TP_2. Then the logic level of the divided-by-4 pulse signal TP_4 is inverted at each rising edge of the divided-by-2 pulse signal TP_2.

A divided-by-8 pulse signal TP_8 transitions from an initial logic high level to a logic low level at a rising edge of the divided-by-4 pulse signal TP_4. Then the logic level of the divided-by-8 pulse signal TP_8 is inverted at each rising edge of the divided-by-4 pulse signal TP_4. A divided-by-16 pulse signal TP_16 transitions from an initial logic high level to a logic low level at a rising edge of the divided-by-8 pulse signal TP_8. Then the logic level of the divided-by-16 pulse signal TP_16 is inverted at each rising edge of the divided-by-8 pulse signal TP_8.

A delayed divided-by-16 pulse signal TP_16D is generated by delaying the divided-by-16 pulse signal TP_16 for a predetermined time. An enable signal EN transitions to low at a falling edge of the delayed divided-by-16 pulse signal TP_16D that is delayed at the initial logic high level. A start pulse masking signal TP_INNER is obtained by performing an OR operation on the enable signal EN that transitions low and the start pulse signal. Thus the start pulse masking signal TP_INNER is generated following the start pulse signal TP after first eight pulses of the start pulse signal TP are masked at a logic high level.

Figure 9:
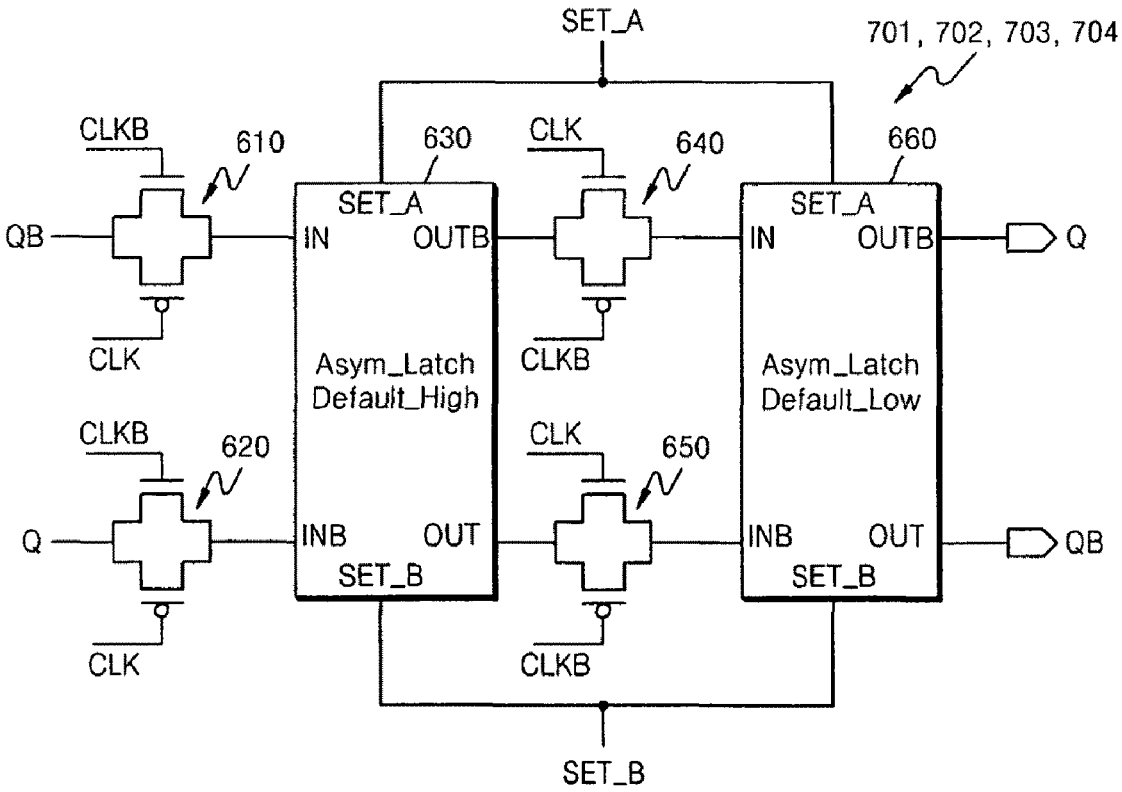
FIG. 9 is a circuit diagram of first through fourth flip-flops of FIG. 7 according to an embodiment.

FIG. 9 is a circuit diagram of the first flip-flop 701 (or the second, third or fourth flip-flops 702, 703, or 704) of FIG. 7 according to an embodiment. Referring to FIG. 9, the first flip-flop 701 (or the second, third or fourth flip-flops 702, 703, or 704) includes a first switch 610 that transmits a signal output from an inversion output terminal QB thereof in response to an inverted clock terminal signal CLKB, and a second switch 620 that transmits a signal output from an output terminal Q thereof in response to the inverted clock terminal signal CLKB. The signal output from the inversion output terminal QB, which is transmitted via the first switch 610, and the signal output from the output terminal Q, which is transmitted via the second switch 620, are respectively supplied to an input terminal IN and an inversion input terminal INB of a first latch 630.

The first latch 630 is an asymmetric latch, and is enabled in response to first and second set signals SET_A and SET_B to set an output terminal OUT of the first latch 630 to be in a default logic high level. Signals output from the inversion output terminal OUTB and output terminal OUT of the first latch 630 are respectively supplied to an input terminal IN and input terminal INB of a second latch 660 via third and fourth switches 640 and 650 that are enabled in response to a clock terminal signal CLK. The second latch 660 is an asymmetric latch and is enabled in response to the first and second set signals SET_A and SET_B to set an output terminal OUT of the second latch 660 to be in a default logic low level. Signals output from an inversion output terminal OUTB and an output terminal OUT of the second latch 660 respectively become signals output from an output terminal Q and an inversion output terminal QB of the first flip-flop 701 (or the second, third or fourth flip-flops 702, 703, or 704).

Figure 10:
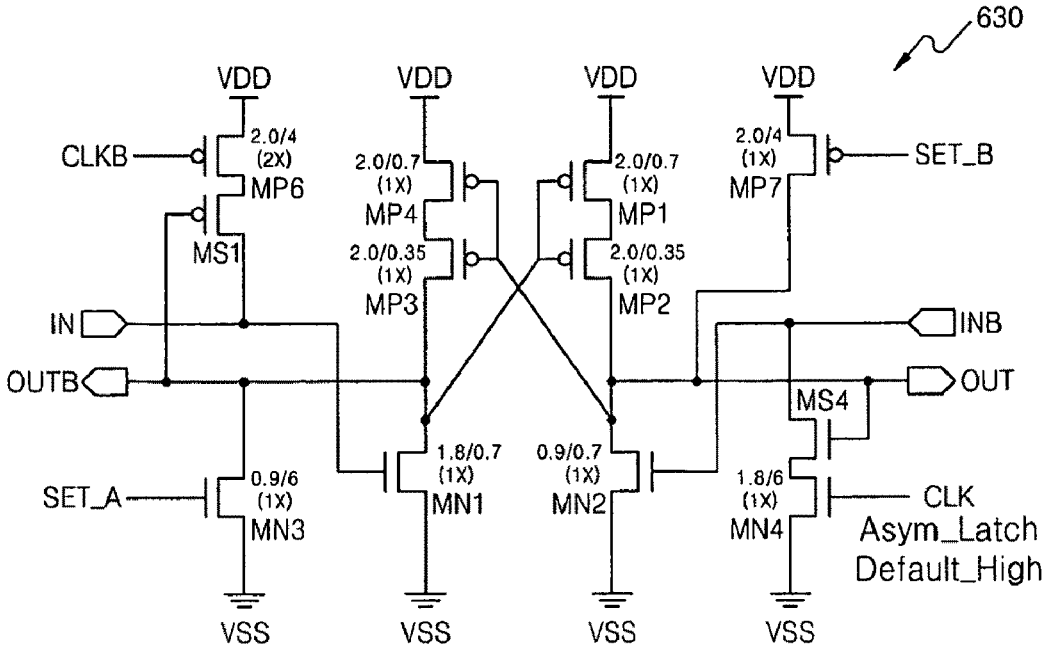
FIG. 10 is a circuit diagram of a first latch of FIG. 9 that is set to be in a default logic high state according to an embodiment.

FIG. 10 is a circuit diagram of the first latch 630 of FIG. 9, which is set to be in a default logic high level, according to an embodiment. Referring to FIG. 10, the first latch 630 has a feedback inverter structure in which input terminals IN and INB are connected to output terminals OUT and OUTB in a feedback manner. The first latch 630 includes a plurality of NMOS transistors MN1, MN2, MN3, and MN4, the sources of which are connected to a ground voltage source VSS. A signal input via the input terminal IN is supplied to a gate of the NMOS transistor MN1 and a signal input via the inversion output terminal OUTB is supplied to a drain of the NMOS transistor MN1. A signal input via the inversion input terminal INB is supplied to a gate of the NMOS transistor MN2 and a signal input via the output terminal OUT is supplied to a drain of the NMOS transistor MN2. A first set signal SET_A is supplied to a gate of the NMOS transistor MN3 and the signal input via the inversion output terminal OUTB is supplied to a drain of the NMOS transistor MN3. A clock terminal signal CLK is supplied to a gate of the NMOS transistor MN4 and a drain of the NMOS transistor MN4 is connected to a source of a transistor MS4. The signal input via the output terminal OUT is supplied to a gate of the transistor MS4 and the signal input via the inversion input terminal INB is supplied to a drain of the NMOS transistor MS4.

PMOS transistors MP3 and MP4 are connected in series between a supply voltage source VDD and the drain of the NMOS transistor MN1. The gates of the PMOS transistors MP3 and MP4 are connected to the drain of the NMOS transistor MN2. PMOS transistors MP1 and MP2 are connected in series between the supply voltage source VDD and the drain of the NMOS transistor MN2. The gates of the PMOS transistors MP1 and MP2 are connected to the drain of the NMOS transistor MN1. A PMOS transistor MP7 is connected between the supply voltage VDD and the output terminal OUT, and a second set signal SET_B is supplied to a gate of the PMOS transistor MP7. PMOS transistors MP6 and MS1 are connected in series between the supply voltage source VDD and the input terminal IN, and an inverted clock terminal signal CLK is supplied to gates of the PMOS transistors MP6 and MS1.

The first latch 630 has an asymmetric structure in which the width of the NMOS transistor MN1 (e.g., 1.8 μm) is twice that of the NMOS transistor MN2 (e.g., 0.9 μm) and the length of the PMOS transistor MP6 is twice (X2) that of the PMOS transistor MP7. Since the current driving capabilities of the transistors are different from each other during a power-on stage, the NMOS transistor MN1 allows the signal of the inversion output terminal OUTB to transition low, the NMOS transistor MN3 that is enabled in response to the first set signal SET_A allows the signal of the inversion output terminal OUTB to transition low, and the PMOS transistor MP6 allows the signal of the input terminal IN to transition high, thereby setting the signal of the inversion output terminal OUTB to low. The PMOS transistor MP7 allows the signal of the output terminal OUT to transition high in response to the second set signal SET_B, and the PMOS transistor MP2 allows the signal of the output terminal OUT to transition high in response to the signal of the inversion output terminal OUTB. Accordingly, the output terminal OUT of the first latch 630 is set to be in a default logic high level.

Figure 11:
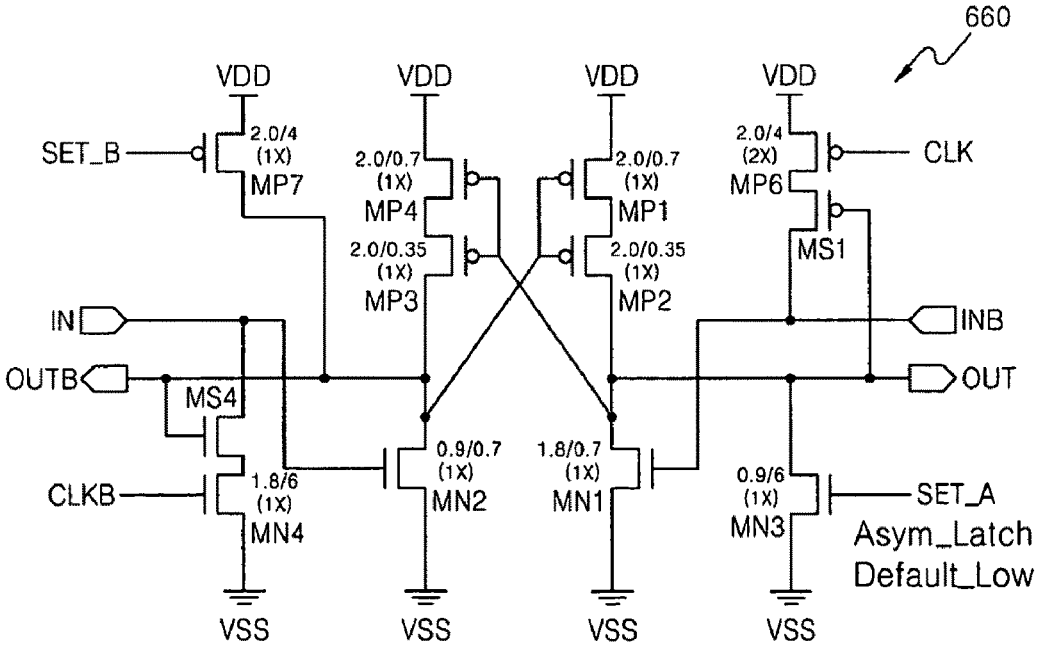
FIG. 11 is a circuit diagram of a second latch of FIG. 9 that is set to be in a default logic low state according to an embodiment.

FIG. 11 is a circuit diagram of the second latch 660 of FIG. 9, which is set to be in a default logic low, according to an embodiment. Referring to FIG. 11, the second latch 660 has the same structure as the first latch 630 of FIG. 11 except that the locations of NMOS transistors MN1 and MN2 are switched, the locations of NMOS transistors MN3, MN4, and MS4 are switched, and the locations of PMOS transistors MP6, MS1 and MP7 are switched. Since the current driving capabilities of the transistors of the second latch 660 are different from each other during a power-on stage, the NMOS transistor MN1 makes a signal of an output terminal OUT transition low, the NMOS transistor MN3 makes a signal of an inversion output terminal OUTB transition low in response to a first set signal SET_A, and the PMOS transistor MP6 makes a signal of an inversion input terminal INB transition high, thereby setting the signal of the output terminal OUT to transition low. The PMOS transistor MP7 makes the signal of the inversion output terminal OUTB transition high in response to a second set signal SET_B and the PMOS transistors MP3 and MP4 make the signal of the inversion output terminal OUTB transition high in response to the signal of the output terminal that transitions low. Accordingly, the output terminal OUT of the second latch 660 is set to be at a logic low level.

Figure 12:
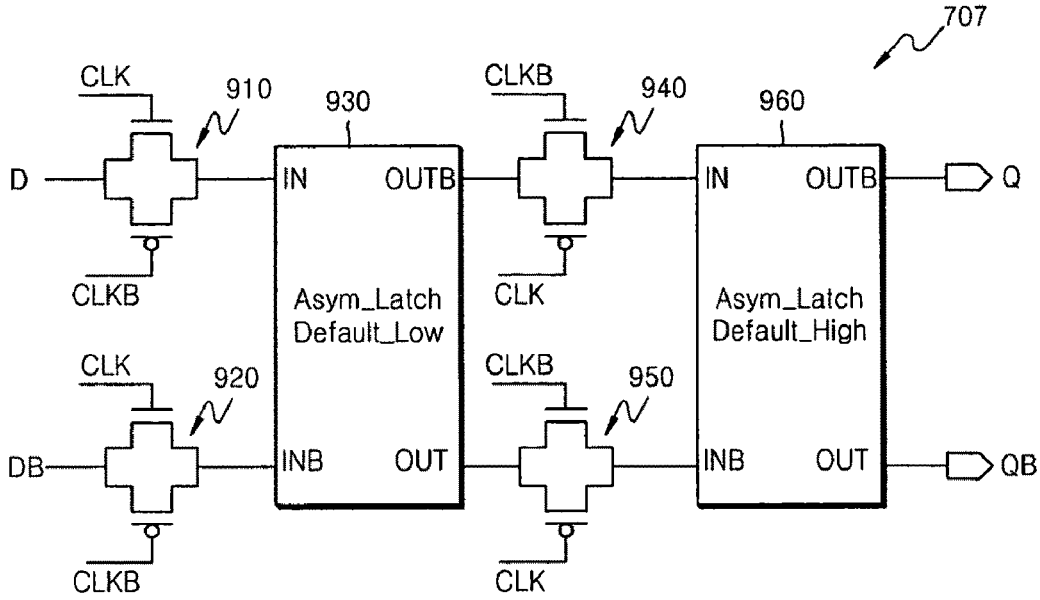
FIG. 12 is a circuit diagram of a fifth flip-flop of FIG. 7 according to an embodiment.

FIG. 12 is a circuit diagram of the fifth flip-flop 707 illustrated in FIG. 7 according to an embodiment. Referring to FIG. 12, the fifth flip-flop 707 includes a first switch 910 that is configured to transmit a signal of a data terminal D in response to a clock terminal signal CLK, and a second switch 920 that is configured to transmit a signal of an inversion data terminal DB in response to the clock terminal signal CLK. The signal of the data terminal D transmitted via the first switch 910 and the signal of the inversion data terminal DB transmitted via the second switch 920 are respectively supplied to an input terminal IN and an inversion input terminal INB of a first latch 930. The first latch 930 is an asymmetric latch as described above with reference to FIG. 11, and an output terminal OUT of the first latch 930 is set to be in a default logic low level. A signal of an inversion output terminal OUTB and a signal of the output terminal OUT of the first latch 930 are respectively supplied to an input terminal IN and an inversion input terminal INB of a second latch 960 via third and fourth switches 940 and 950 in response to an inverted clock terminal signal CLKB. The second latch 960 is an asymmetric latch as described above with reference to FIG. 10, and an output terminal OUT of the second latch 960 is set to be in a default logic low level. A signal of an inversion output terminal OUTB and a signal of an output terminal OUT of the second latch 960 respectively become a signal of an output terminal Q and a signal of an inversion output terminal QB of the fifth flip-flop 707.

Figure 13:
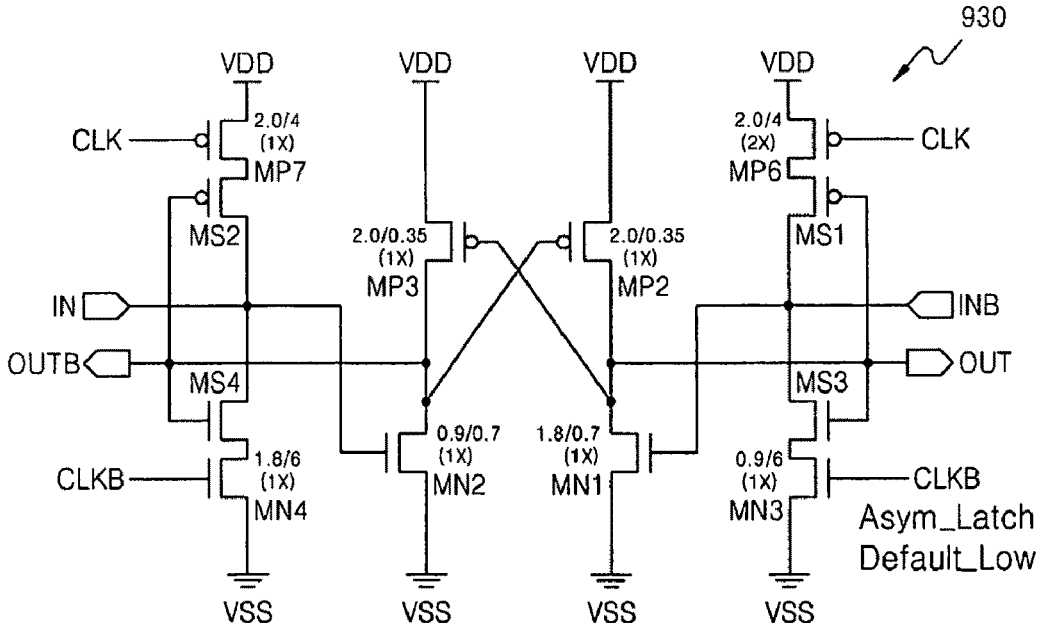
FIG. 13 is a circuit diagram of a first latch of FIG. 12 that is set to be in a default logic low state according to an embodiment.

FIG. 13 is a circuit diagram of the first latch 930 of FIG. 12 according to an embodiment. Referring to FIG. 13, the first latch 930 is different from the second latch 660 of FIG. 11, in that a PMOS transistor MP3 is directly connected to a supply voltage source VDD without a PMOS transistor MP4 and a PMOS transistor MP2 is directly connected to the supply voltage VDD without MP1 PMOS transistor. Also, PMOS transistors MP7 and MS2 are connected in series between the supply voltage source VDD and an input terminal IN in comparison with the second latch 660 of FIG. 11. A clock terminal signal CLK is supplied to a gate of the PMOS transistor MP7 and a signal of an inversion output terminal OUTB is supplied to a gate of the PMOS transistor MS2. Also, NMOS transistors MS3 and MN3 are connected in series between an inversion input terminal INB and a ground voltage source VSS in comparison with the second latch 660 of FIG. 11. A signal of an output terminal OUT is supplied to a gate of the NMOS transistor MS3 and an inverted clock terminal signal CLK is supplied to a gate of the NMOS transistor MN3.

Figure 14:
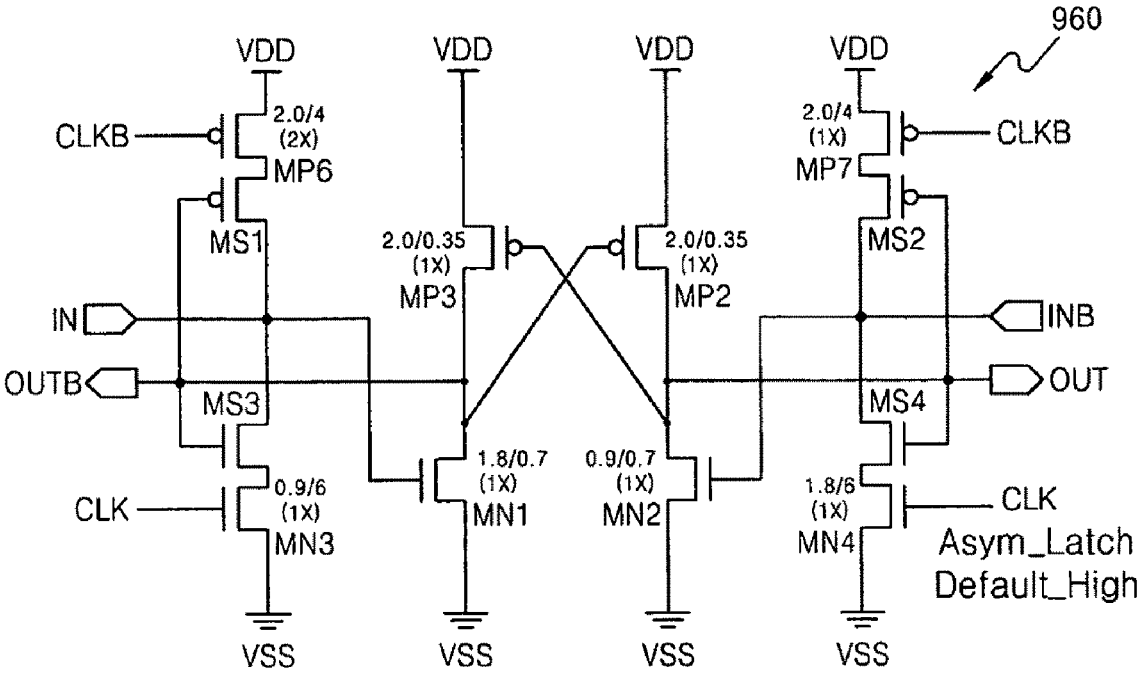
FIG. 14 is a circuit diagram of a second latch of FIG. 12 that is set to be in a default logic high state according to an embodiment.

FIG. 14 is a circuit diagram of the second latch 960 of FIG. 12 according to an embodiment. Referring to FIG. 14, the second latch 960 is different from the first latch 630 of FIG. 10, in that a PMOS transistor MP3 is directly connected to a supply voltage source VDD without a PMOS transistor MP4 and a PMOS transistor MP2 is directly connected to the supply voltage source VDD without a PMOS transistor MP1. PMOS transistors MP7 and MS2 are connected in series between the supply voltage source VDD and an inversion input terminal INB in comparison with the first latch 630 of FIG. 10. An inverted clock terminal signal CLKB is supplied to a gate of the PMOS transistor MP7 and a signal of an output terminal OUT is supplied to a gate of the PMOS transistor MS2. Also, NMOS transistors MS3 and MN3 are connected in series between an input terminal IN and a ground voltage source VSS in comparison with the first latch 630 of FIG. 10. A signal of an inversion output terminal OUTB is supplied to a gate of the NMOS transistor MS3 and a clock terminal signal CLK is supplied to a gate of the NMOS transistor MN3.

Figure 15:
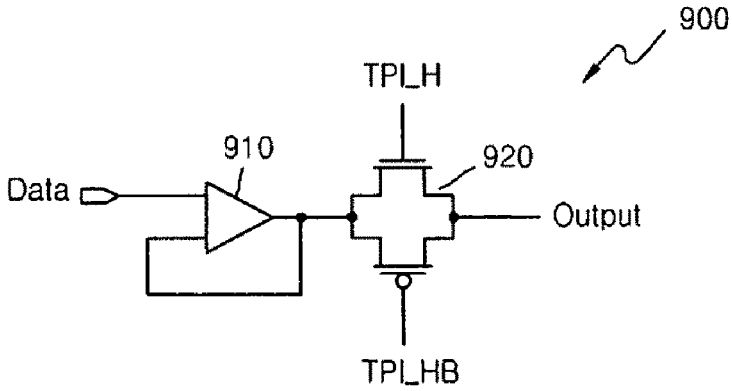
FIG. 15 is a circuit diagram of an output buffer of FIG. 14 according to an embodiment.

FIG. 15 is a circuit diagram of the output buffer 900 of FIG. 4 according to an embodiment. Referring to FIG. 15, the output buffer 900 includes an amplification unit 910 that receives image data Data, and a switch 920 that delivers an output of the amplification unit 910 as an output signal Output for driving source lines of a LCD panel, in response to first and second switching signals TPI_H and TPI_HB. Again of the amplification unit 910 is set to '1'.

Figure 16:
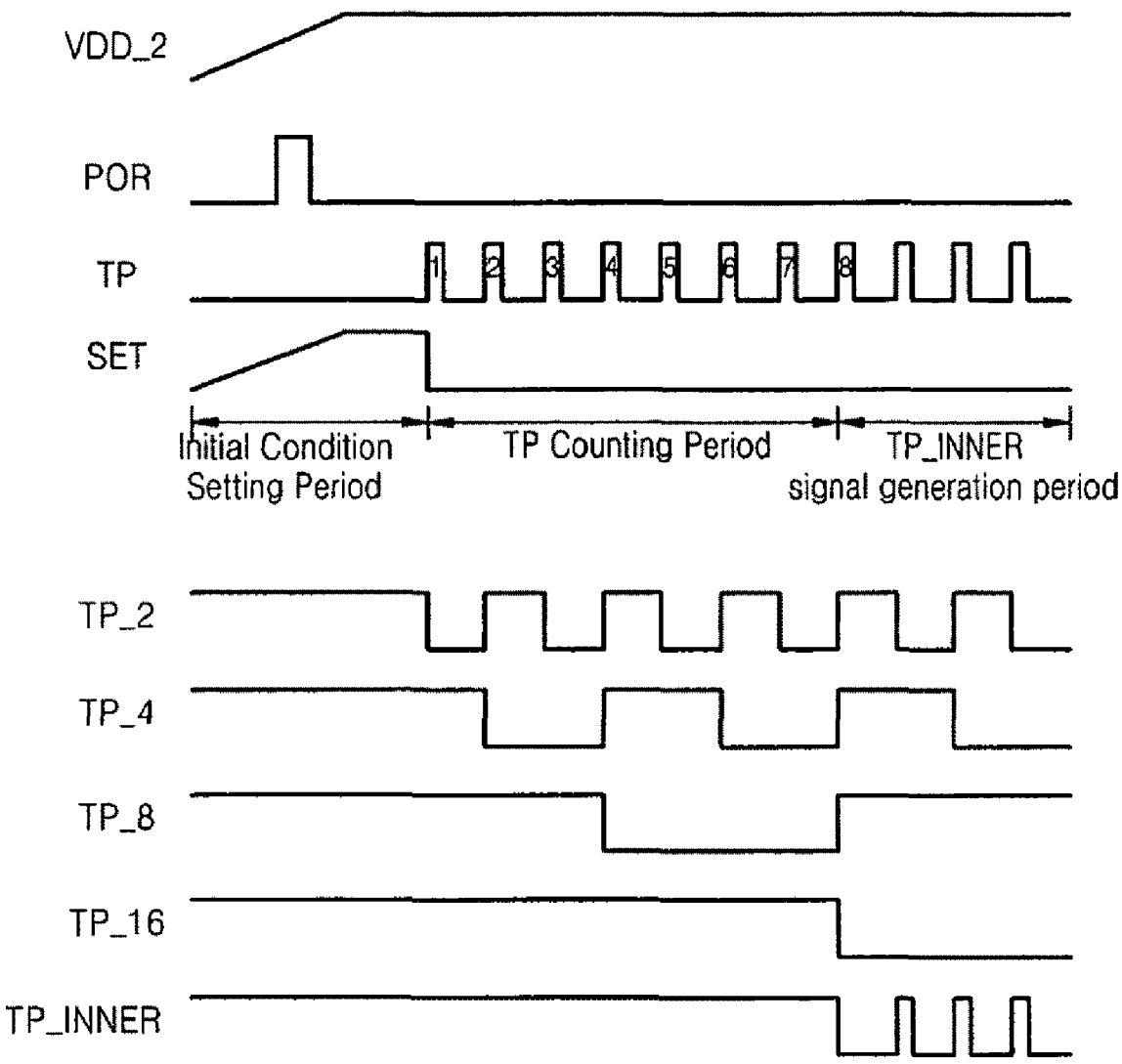
FIG. 16 is a timing diagram illustrating operation of the LCD panel driver of FIG. 4 according to an embodiment.

FIG. 16 is a timing diagram illustrating an operation of the LCD panel driver 400 of FIG. 4 according to an embodiment. Referring to FIG. 16, if a second power supply VDD_2 is powered up, a power-on reset signal POR is generated in the form of a pulse signal. A set signal SET that transitions low is generated after a time period in which an initial condition of the latch unit 600 of FIG. 6 is set in response to the power-on reset signal POR. A first set signal SET_A (not shown) that transitions high and a second set signal SET_B (not shown) that transitions low are generated in response to the set signal SET that transitions low. The counter unit 700 of FIG. 7 that is enabled in response to the first and second set signals SET_A and SET_B generates a divided-by-2 pulse signal TP_2, a divided-by-4 pulse signal TP_4, a divided-by-8 pulse signal TP_8, and a divided-by-16 pulse signal TP_16, in response to a start pulse signal TP that is input after transitions low. A start pulse masking signal TP_INNER is generated following the start pulse signal TP after the divided-by-16 pulse signal transitions low, that is, after first eight pulses of the start pulse signal TP are masked at a logic high level.

Figure 17:
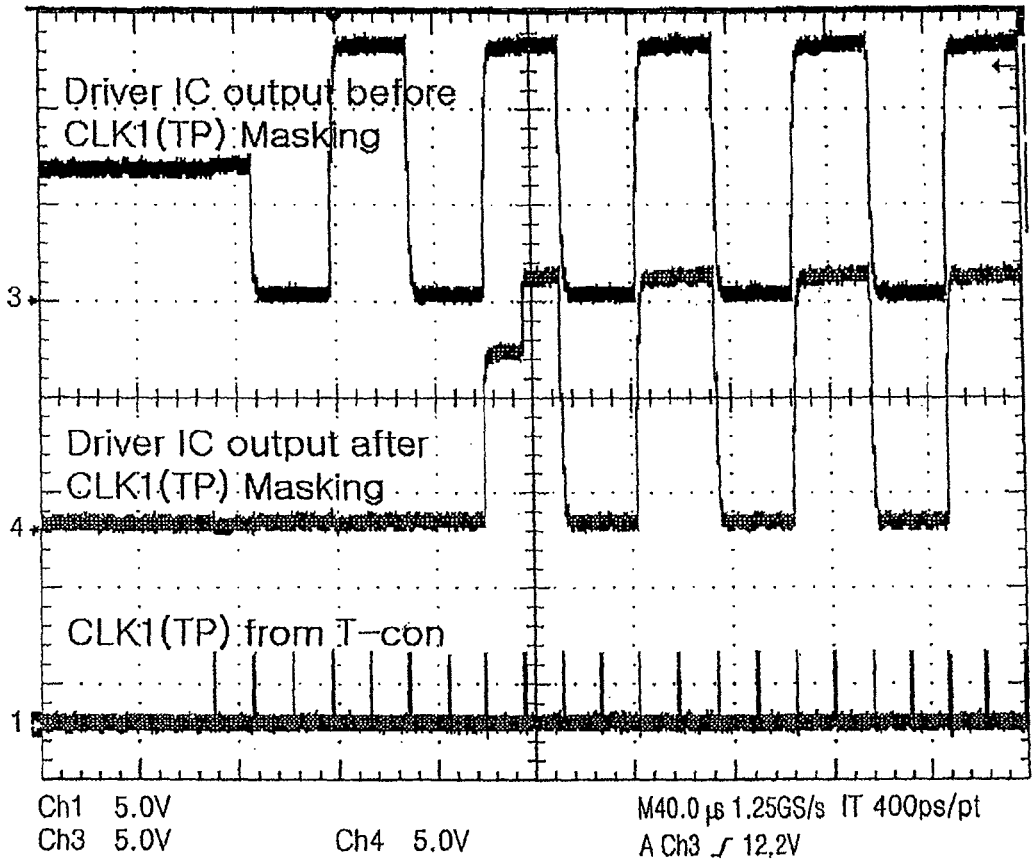
FIG. 17 is a graph illustrating the result of a test of operating the LCD panel driver of FIG. 4.

FIG. 17 is a graph illustrating the result of a test of operating the LCD panel driver 400 of FIG. 4 according to an embodiment. Referring to FIG. 17, a start pulse signal TP was sequentially transmitted from a timing controller. Also, FIG. 17 shows an output of a driver integrated circuit (IC) having the LCD panel driver 400 when first eight pulses of the start pulse signal TP were masked in comparison with an output a conventional driver IC when the start pulse signal TP was not masked.

While the inventive concept has been particularly shown and described with reference to exemplary embodiments thereof, it will be understood that various changes in form and details may be made therein without departing from the spirit and scope of the following claims. In the present specification, it is described that the start pulse masking signal TP_INNER is generated following the start pulse signal TP after first eight pulses of the start pulse signal TP are masked at a logic high level but is not limited thereto and may be generated following the start pulse signal TP after first one, two, three, . . . , $2^N$ pulses of the start pulse signal TP are masked (N is a natural number), depending on the desired device configuration.

What is claimed is:

1. An LCD (liquid crystal display) panel driver comprising:

a power-on reset signal generation unit that generates a power-on reset signal in response to a supply voltage applied to a LCD panel;

a latch unit that receives a horizontal start pulse signal instructing that source lines of the LCD panel be driven, and that generates first and second set signals for setting an initial value of an output signal of a flip-flop to be a predetermined default logic level, in response to the power-on reset signal; and a counter unit comprising the flip-flop that is enabled in response to the first and second set signals and the horizontal start pulse signal, and that generates a horizontal start pulse masking signal by masking at least one pulse of the horizontal start pulse signal, the horizontal start pulse masking signal configured to mask a signal to be applied to a pixel source line of the LCD panel.

2. The driver of claim 1, wherein the supply voltage is a high supply voltage for driving a source driver.

3. The driver of claim 1, further comprising:

a level shifter that generates first and second switching signals by boosting a voltage of the horizontal start pulse masking signal to a high voltage; and an output buffer that transmits image data as an output signal for driving the source lines of the LCD panel, in response to the first and second switching signals.

4. The driver of claim 1, wherein the power-on reset signal generation unit comprises:

a bias unit that generates first and second node voltages when the supply voltage is powered up;

a current mirror unit comprising first and second current mirrors which generate third node voltages in response to the second node voltage; and a buffer unit that generates the power-on reset signal by buffering the first node voltage.

5. The driver of claim 4, wherein the bias unit comprises:

a first PMOS transistor having a source to which the supply voltage is applied and a gate and drain to which first node voltage is applied;

a second NMOS transistor having a drain to which the first node voltage is applied, a gate to which the third node voltage is applied, and a source to which a ground voltage is applied; and a third NMOS transistor having a gate to which the first node voltage is applied, a drain to which the second node voltage is applied, and a source to which the ground voltage is applied.

6. The driver of claim 5, wherein the current mirror unit comprises:

a fourth PMOS transistor having a source to which the supply voltage is applied, and a gate and drain to which the second node voltage is applied;

a sixth PMOS transistor having a source to which the supply voltage is applied, a gate to which the second node voltage is applied, and a drain to which the third node voltage is applied, where the sixth PMOS transistor forms the first current mirror together with the fourth PMOS transistor;

a fifth NMOS transistor having a source to which the ground voltage is applied, a drain connected to the drain of the fourth PMOS transistor, and a gate to which the third node voltage is applied; and a seventh NMOS transistor having a source to which the ground voltage is applied and a gate and drain to which the third node voltage is applied, where the seventh NMOS transistor forms the second current mirror together with the fifth NMOS transistor.

7. An LCD (liquid crystal display) panel driving method comprising:

generating a power-on reset signal in response to a supply voltage applied to a LCD panel;

receiving a horizontal start pulse signal instructing that source lines of the LCD panel be driven from a timing controller;

generating a set signal for setting an initial value of an output signal of a flip-flop to be a predetermined default logic level, in response to the power-on reset signal;

generating a horizontal start pulse masking signal by masking at least one pulse of the horizontal start pulse signal using a flip-flop that is enabled in response to the set signal and the horizontal start pulse signal; and driving the source lines in response to the horizontal start pulse masking signal, wherein the driving of a source line of an LCD pixel is masked for at least one pulse period of the horizontal start pulse signal.

8. The method of claim 7, wherein the horizontal start pulse masking signal controls switches between the source lines of the LCD panel and a source driver.

9. The method of claim 7, wherein the generating of the horizontal start pulse masking signal comprises:

generating a divided-by-2 pulse signal, where the divided-by-2 pulse signal is driven by applying a first supply voltage and is set to be in an logic high level in response to the set signal, and the logic level of the divided-by-2 pulse signal is inverted at each of rising edges of the horizontal start pulse signal;

generating a divided-by-4 pulse signal, where the divided-by-4 pulse signal is driven by applying the first supply voltage and is set to be in an initial logic high level in response to the set signal, and the logic level of the divided-by-4 pulse signal is inverted at each of rising edges of the divided-by-2 pulse signal;

generating a divided-by-8 pulse signal, where the divided-by-8 pulse signal is driven by applying the first supply voltage and is set to be in an initial logic high level in response to the set signal, the logic level of the generating a divided-by-8 pulse signal is inverted at each of rising edges of the divided-by-4 pulse signal;

generating a divided-by-16 pulse signal, where the divided-by-16 pulse signal is driven by applying the first supply voltage and is set to be in an initial logic high level in response to the set signal, and the logic level of the generating a divided-by-16 pulse signal is inverted at each of rising edges of the divided-by-8 pulse signal;

generating a delayed divided-by-16 pulse signal by delaying the divided-by-16 pulse signal for a predetermined time;

generating an enable signal at a falling edge of the delayed divided-by-16 pulse signal and in response to the divided-by-2 pulse signal and the inverted divided-by-2 pulse signal; and generating the horizontal start pulse masking signal by performing an OR operation on the enable signal and the horizontal start pulse signal.

10. The method of claim 9, wherein the first supply voltage is a supply voltage for driving a logic circuit of the source driver.

* * * * *